United States Patent [19]

Grenci

[11] 4,133,229

[45] Jan. 9, 1979

[54] IMPACTING APPARATUS

[76] Inventor: Carl A. Grenci, 4791 Lesa Pl., Yorba Linda, Calif. 92686

[21] Appl. No.: 659,542

[22] Filed: Feb. 19, 1976

[51] Int. Cl.[2] ..... B25B 19/00

[52] U.S. Cl. ..... 81/52.3

[58] Field of Search ..... 81/52.3, 52.35; 29/243.53, 243.54; 72/448, 446; 227/137

[56] References Cited

U.S. PATENT DOCUMENTS

| | | | |
|---|---|---|---|
| 2,313,270 | 3/1943 | Sapp | 81/377 |
| 2,354,841 | 8/1944 | Shaff | 227/130 |
| 3,576,064 | 4/1971 | Brackin | 81/52.35 |

*Primary Examiner*—James L. Jones, Jr.
*Attorney, Agent, or Firm*—Philip M. Hinderstein

[57] ABSTRACT

An impacting apparatus comprising a hammer assembly including a housing and a driven, reciprocating ram extending axially from one end of the housing; an anvil assembly including a housing and a manually adjustably anvil extending axially from one end of the housing; and a pair of arms for connecting the one end of the anvil assembly housing to the one end of the hammer assembly housing with the anvil in facing, spaced, coaxial relationship to the reciprocating ram. Such impacting apparatus may be used to loosen threaded members that are tightly engaged by positioning such members between the anvil and the ram.

6 Claims, 5 Drawing Figures

IMPACTING APPARATUS

BACKGROUND OF THE INVENTION

1. Field of the Invention

The present invention relates to an impacting apparatus and, more particularly, to an impacting or vibrating apparatus used to loosen threaded members that are tightly engaged without the application of excessive force that could result in distortion or damage to either or both of the members.

2. Description of the Prior Art

In the field of compressed gas cylinders, valves are connected to the necks of the cylinders for controlling the flow of compressed gas therefrom. Practically all valves on such compressed gas cylinders are enclosed in a protective steel cap that screws onto a threaded collar attached to the neck of the cylinder, such cap being used while the cylinder is in transportation or storage. Normally, because of continued and constant use of the cylinders, the threads on the cap and collar remain free and relatively easy to turn. There is no provision made to lubricate such threads nor is it desirable to do so in the case of oxygen cylinders and other compressed gas cylinders.

On the other hand, if the cylinders are allowed to remain idle for extended periods and are exposed to high humidity or inclement weather, corrosion will usually form on the mating threads of the cap and collar. If allowed to continue, the corrosion will form a bond between these two parts. This bond requires extreme force to break and the result has generally been damage to or destruction of the protective cap and collar in order to separate the two parts.

Past methods of removal have utilized hammers, rivet guns, metal saws, penetrant oils, chisels, and oxy-acetylene cutting torches and the expenditure of considerable labor, with the attendant possibility of injury because of the forces required and equipment involved. All these methods also involve moving the cylinder to another area or clamping it in a vise.

In the case of small compressed gas cylinders, such as carbon dioxide cylinders or small medical gas cylinders, valve protection caps are generally not used and, therefore, such cylinders do not have engagement collars affixed to them. However, such cylinders still have female neck threads which receive the male threads of the cylinder valves. As is the case with valve protection caps, if the valves remain in the cylinders for extended periods of time, the threads may sieze, preventing the removal of the valve from the cylinder. The same difficulty exists if the valve was installed with an expanding cement-type sealing compound. As a result, when an attempt is made to remove such valves, the cross-sectional area of the threads is insufficient for the torque required and the valve will often twist off. When this happens, not only is a good valve destroyed, but additional time consuming work is required to remove the broken valve shank from the cylinder. Even if the valve does not twist off, the high torque requirements may destroy or damage the valve body, rendering it useless.

Past methods of removal of the valves from small cylinders have been similar to those described previously with regard to valve protection caps. In addition, hammers have been used to impact the neck of the cylinder, on opposite sides thereof, to cause the neck to flex, to loosen the bond between the valve and the cylinder neck. Such impacting, however, requires a fair degree of skill and coordination and the attendent possibility of a slip that could damage either the valve or the surrounding equipment or personnel.

SUMMARY OF THE INVENTION

According to the present invention, there is provided an impacting apparatus which is operative to loosen threaded members that are tightly engaged, thereby solving the problems discussed hereinabove. The present impacting apparatus allows loosening of two threaded members so that the members may be separated without the application of excessive force that can result in distortion or damage to either or both of the members. The present apparatus is simple, effective, and easy to use and virtually eliminates the possibility of injury to surrounding equipment or personnel. The present apparatus may be used with a cylinder where it is located and does not require clamping in a vise. The present impacting apparatus is equally adaptable to loosening valve protection caps as well as removing valves from compressed gas cylinders. Use of the present impacting apparatus does not require any great degree of skill and coordination by an operator.

Briefly, the present impacting apparatus comprises: a hammer assembly including an elongate housing connectable to a source of compressed air for driving a reciprocating ram which extends axially from one end of the hammer assembly housing; an anvil assembly including a housing and a manually adjustably anvil extending axially from one end of the anvil assembly housing; and a pair of C-shaped arms for connecting the one end of the anvil assembly housing to the one end of the hammer assembly housing with the anvil in facing, spaced, coaxial relationship to the ram whereby the neck of a compressed gas cylinder may be positioned between the anvil and the ram. A rest arm is pivotably connected between the connector arms for resting against the neck of a compressed gas cylinder when removing a valve therefrom.

OBJECTS

It is therefore an object of the present invention to provide an impacting apparatus which may be used to loosen threaded members that are tightly engaged.

It is a further object of the present invention to provide an impacting apparatus for removing valve protection caps from compressed gas cylinders.

It is a still further object of the present invention to provide an impacting apparatus for removing valves from compressed gas cylinders.

It is another object of the present invention to provide an impacting apparatus which allows loosening of two threaded members so that such members may be separated without the application of excessive force that can result in distortion or damage to either or both of the members.

It is still another object of the present invention to provide an impacting apparatus which minimizes the possibility of injury to equipment or personnel.

Another object of the present invention is the provision of an impacting apparatus which may be readily used by unskilled personnel.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
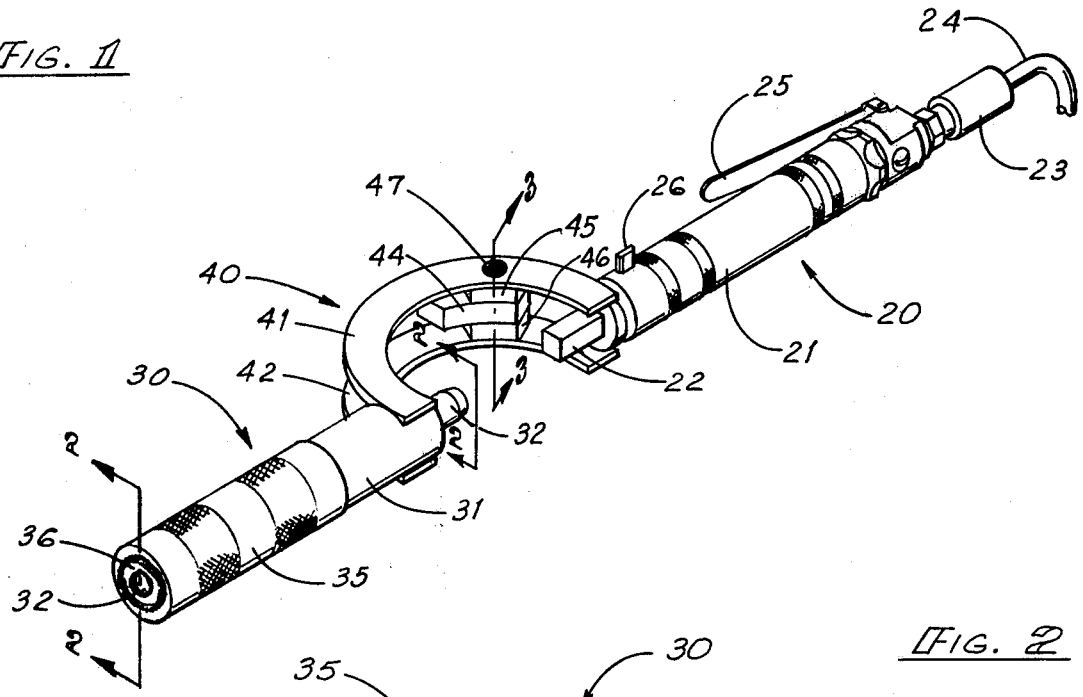
FIG. 1 is a perspective view of an impacting apparatus constructed in accordance with the teachings of the present invention.
Figure 2:
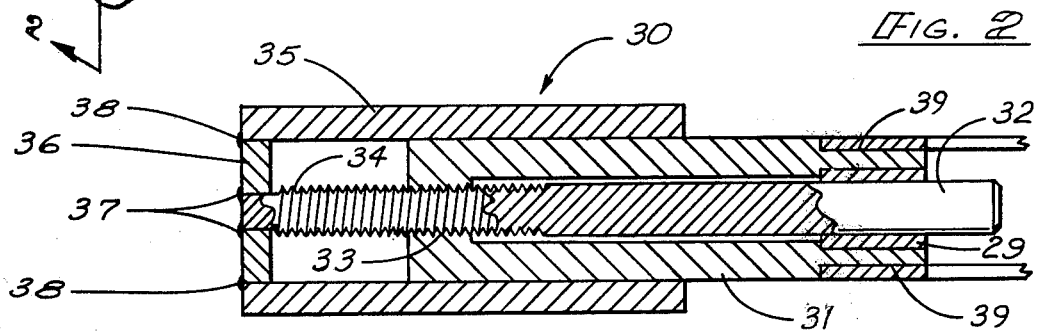
FIG. 2 is an enlarged, partial, sectional view taken along the line 2—2 in FIG. 1.
Figure 3:
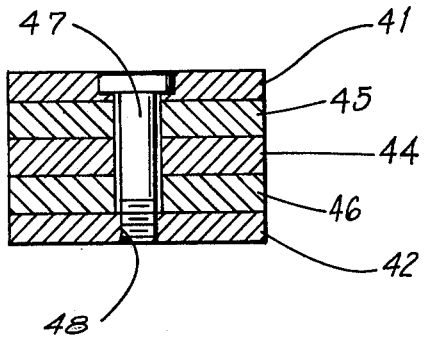
FIG. 3 is an enlarged sectional view taken along the line 3—3 in FIG. 1.

Referring now to the drawings and, more particularly to FIGS. 1-3 thereof, the present impacting apparatus, generally designated 10, comprises a hammer assembly, generally designated 20, an anvil assembly, generally designated 30, and means, generally designated 40, for connecting anvil assembly 30 to hammer assembly 20. More particularly, hammer assembly 20 is preferrably an air driven impacting tool of a type well known to those skilled in the art including an elongate, generally cylindrical housing 21 having an impacting tool or ram 22 extending axially from one end thereof. The other end of housing 21 is connectable via a quick disconnect coupling 23 to a hose 24 which is connectable to a source of compressed air. Housing 21 also has a control lever 25 pivotably connected thereto. As is well known to those skilled in the art, movement of control level 25 towards housing 21 causes ram 22 to reciprocate axially by approximately one quarter to one half inch. Housing 21 may also include a ram release lever 26 which, upon depression thereof, permits removal of ram 22 from housing 21 for changing of same. Air driven impacting tools as described above are well known to those skilled in the art.

Anvil assembly 30 includes a sleeve-like housing 31 and an anvil 32 which extends axially therethrough, one end of anvil 32 extending outwardly beyond one end of housing 31. The other end of housing 31 is internally threaded, at 33. Anvil 32 is a shaft-like member having external threads 34 covering approximately half thereof, adjacent the other end thereof, threads 34 on anvil 32 engaging threads 33 in housing 31 so that anvil 32 is axially movable relative to housing 31 upon rotation thereof. A washer 29 positioned between the one end of housing 31 and anvil 32 seals the area therebetween.

Rotation of shaft 32 is conveniently achieved by means of a handle 35 which is a sleeve-like member having an inside diameter approximately equal to the outside diameter of housing 31 so that the other end of housing 31 may be extended into handle 35, from one end thereof. A disc 36 having an inside diameter approximately equal to the outside diameter of anvil 32 and an outside diameter approximately equal to the inside diameter of handle 35 is positioned between the other ends of shaft 32 and handle 35. Disc 36 may be connected to shaft 32 and handle 35 by welding at 37 and 38, respectively. Accordingly, rotation of handle 35 relative to housing 31 rotates anvil 32 therewith and adjusts the axial position of anvil 32 relative to housing 31.

Connecting means 40 includes a pair of C-shaped arms 41 and 42 positioned in parallel, spaced relationship, the opposite ends of arms 41 and 42 being connected to the facing ends of housings 21 and 31. More particularly, the facing ends of housings 21 and 31 may be provided with flats on the opposite sides thereof, as shown at 39 on housing 31. Upon positioning of the ends of arms 41 and 42 in such flats, arms 41 and 42 may be connected to housings 21 and 31 by welding. This positions anvil 32 in facing, spaced, coaxial relationship to ram 22.

Impacting apparatus further comprises a curved rest arm 44 positioned between arms 41 and 42 and having a radius of curviture approximately equal to and a length shorter than the length of arms 41 and 42. A pair of spacers 45 and 46 may be positioned on opposite sides of rest arm 44, adjacent arms 41 and 42, respectively. One end of rest arm 44 is pivotably connected between arms 41 and 42, such pivotable connection being conveniently achieved by passing a socket head bolt 47 through aligned holes in arms 41, 42, and 44 and spacers 45 and 46. By threading the hole 48 in arm 42, bolt 47 may be utilized to tighten rest arm 44 and spacers 45 and 46 between arms 41 and 42.

OPERATION

Figure 4:
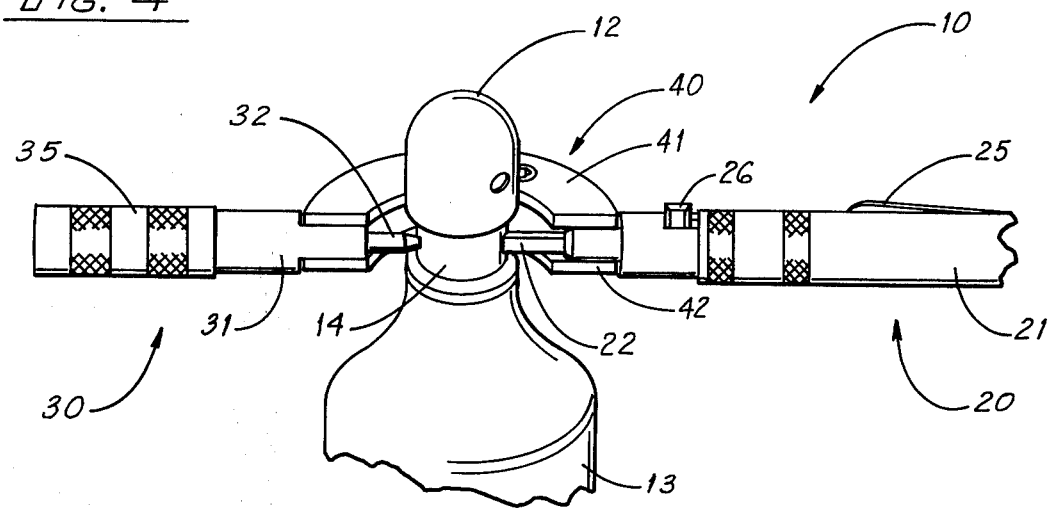
FIG. 4 is a perspective view of the impacting apparatus of FIGS. 1-3 shown in use removing a corroded or otherwise siezed valve protection cap from a compressed gas cylinder.

Referring now to FIG. 4, impacting apparatus 10 may be utilized to remove the valve protection cap 12 from a compressed gas cylinder 13. For use in removing valve protection caps, bolt 47 is loosened and arm 44 is rotated to the position shown in FIG. 1 where it is parallel to arms 41 and 42 and fully retracted therebetween. The radius of curvature of the inner surface of arms 41 and 42 is adjusted so that with hammer assembly 20 and anvil assembly 30 of apparatus 10 on opposite sides of valve protection cap 12, arms 41 and 42 contact cap 12 when ram 22 and anvil 32 are aligned with the diameter of cap 12. Handle 35 is rotated to retract anvil 32 until the threaded portion 14 of cap 12 will fit between ram 22 and anvil 32. Housing 21 is held in one hand while handle 35 is held in the other hand and control lever 25 is depressed to cause ram 22 to impact portion 14 of cap 12.

Impacting apparatus 10 rapidly compresses and releases portion 14 of cap 12 at two points approximately 180° apart, causing the circumference of cap 12 to flex, loosening the bond between cap 12 and the collar of cylinder 13. This force also pulverizes the rust bond therebetween, allowing it to sift out between the threads, providing further thread clearance. Impacting apparatus 10 is moved around cap 12 so as to constantly impact different points thereon until a hollow clatter is heard or cap 12 begins to rotate indicating that it has been loosened. As soon as this occurs, apparatus 10 is withdrawn, permitting cap 12 to be readily removed from cylinder 12.

Figure 5:
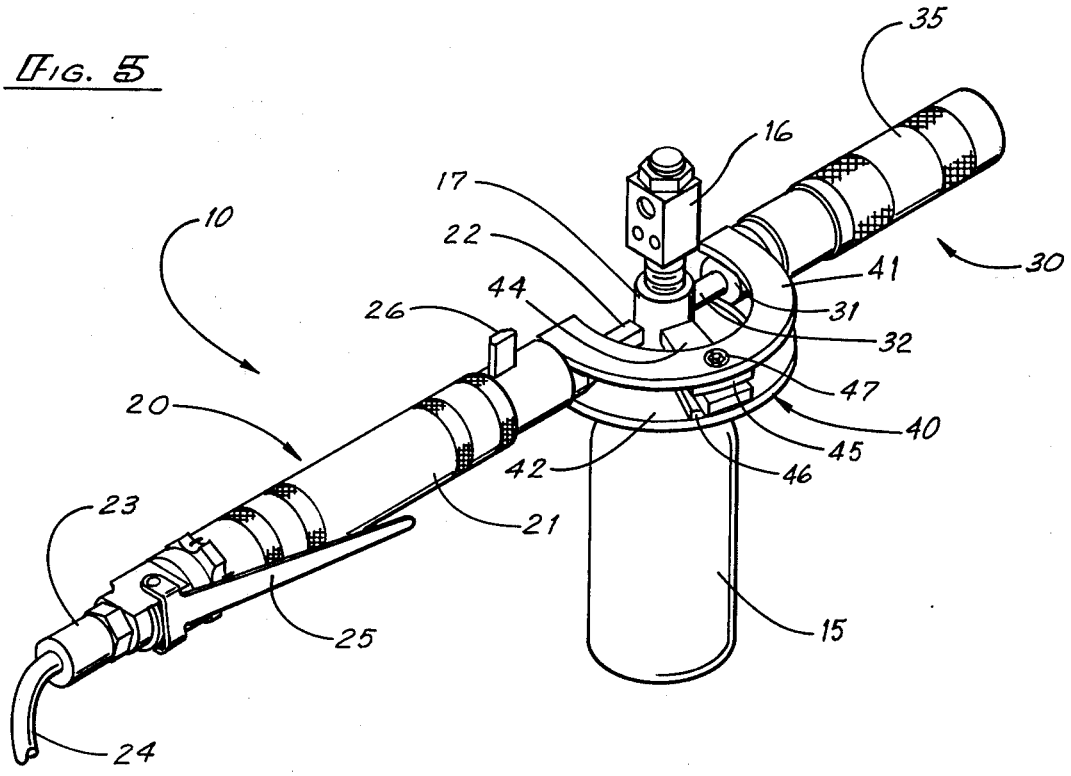
FIG. 5 is a perspective view of the impacting apparatus of FIGS. 1-3 shown in use impacting the neck of a small compressed gas cylinder to allow easy removal of the valve therefrom.

Referring now to FIG. 5, impacting apparatus 10 may also be readily used on small cylinders 15 to assist in the removal of a valve 16 therefrom. For this use, handle 35 is rotated to extend anvil 32 from housing 31 so as to adjust the spacing between ram 22 and anvil 32 to correspond approximately to the outside diameter of neck 17 of cylinder 15. Bolt 47 is now loosened with an Allen wrench and swung toward neck 17. With rest arm 44 in the position shown in FIG. 5, bolt 47 is tightened. Thus, ram 22, anvil 32, and rest arm 44 form a pocket to center impacting apparatus 10 around neck 17 of cylinder 15.

With apparatus 10 so positioned, operation is as described above. Apparatus 10 is held in both hands, control lever 25 is depressed, and impacting apparatus 10 is moved around neck 17 of cylinder 15. This operation proceeds until the bond between valve 16 and neck 17 of cylinder 15 is loosened, permitting the easy removal of valve 16 from cylinder 15.

It can therefore be seen that impacting apparatus 10 provides a simple, safe, easy means for applying impact forces to threaded members to loosen them so that they may be separated without the application of excessive force that can result in distortion or damage to either or both of the members. The side entry of apparatus 10 makes it easy to apply to an item to be impacted. Curved arms 41 and 42 make it possible to center and retain items between ram 22 and anvil 32. In addition, movable rest arm 44 makes apparatus 10 equally applicable to small cylinders as it is to large cylinders having valve protection caps. Impacting apparatus 10 may be used with a cylinder where it is located and does not require clamping in a vise. Furthermore, use of impacting apparatus 10 does not require any great degree of skill and coordination by an operator.

While the invention has been described with respect to a preferred physical embodiment constructed in accordance therewith, it will be apparent to those skilled in the art that various modifications and improvements may be made without departing from the scope and spirit of the invention. For example, while the present impacting apparatus has been described in its use in the handling and maintenance of compressed gas cylinders, it will be obvious to those skilled in the art that the present impacting apparatus may be used to loosen many other types of threaded members that are tightly engaged. Furthermore, while hammer assembly 20 has been described as an air driven impacting tool, other hammer assemblies are equally suitable. Accordingly, it is to be understood that the invention is not to be limited by the specific illustrative embodiment, but only by the scope of the appended claims.

I claim:

1. An impacting apparatus for loosening valve protective caps on the necks of compressed gas cylinders and cylinder valves in the necks of such cylinders comprising:

a hammer assembly including a housing and a driven, vibratory ram extending axially from said housing and being operative to reciprocate axially relative thereto;

an anvil assembly including a housing and an anvil extending axially from said housing; and means for connecting said anvil assembly housing to said hammer assembly housing with said anvil in facing, spaced, co-axial relationship to said ram, the axial position of said anvil being manually adjustable relative to said anvil assembly housing between a first position in which said anvil and said ram are spaced sufficiently to receive therebetween a valve protection cap secured to the neck of a large compressed gas cylinder and a second position in which said anvil and said ram are closely adjacent opposite sides of the neck of a small compressed gas cylinder.

2. An impacting apparatus according to claim 1 wherein said hammer assembly is adapted to be connected to a source of compressed air for driving said reciprocating ram.

3. An impacting apparatus comprising:

a hammer assembly including a housing and a driven, vibratory ram extending axially from said housing and being operative to reciprocate axially relative thereto;

an anvil assembly including a housing and an anvil extending axially from said housing, the axial position of said anvil being manually adjustable relative to said anvil assembly housing;

a pair of C-shaped arms positioned in parallel, spaced relationship, the opposite ends of said arms being connected to said anvil assembly housing and said hammer assembly housing for connecting said anvil assembly housing to said hammer assembly housing with said anvil in facing, spaced, coaxial relationship to said ram;

a rest arm; and means for pivotably connecting one end of said rest arm between said C-shaped arms, the other end of said rest arm being selectively extendable towards said anvil and said ram for resting an element to be impacted positioned therebetween thereon.

4. An impacting apparatus comprising:

a hammer assembly including a housing and a driven, vibratory ram extending axially from said housing and being operative to reciprocate axially relative thereto;

an anvil assembly including a housing and an anvil extending axially from said housing;

means for connecting said anvil assembly housing to said hammer assembly housing with said anvil in facing, spaced, co-axial relationship to said ram;

a rest arm; and means for pivotably connecting one end of said rest arm to said connecting means, the other end of said rest arm being selectively extendable towards said anvil and said ram for resting an element to be impacted positioned therebetween thereon.

5. An apparatus according to claim 4 wherein said connecting means comprises:

a pair of C-shaped arms positioned in parallel, spaced relationship, the opposite ends of said arms being connected to the facing ends of said anvil assembly housing and said hammer assembly housing.

6. An impacting apparatus according to claim 5 wherein said one end of said rest arm is pivotably connected between said C-shaped arms and is retractable therebetween.

* * * * *